US005651703A

United States Patent [19]

Sasai

[11] Patent Number: 5,651,703

[45] Date of Patent: Jul. 29, 1997

[54] CONNECTOR

[75] Inventor: Osamu Sasai, Yokkaichi, Japan

[73] Assignee: Sumitomo Wiring Systems, Ltd., Japan

[21] Appl. No.: 510,548

[22] Filed: Aug. 2, 1995

[30] Foreign Application Priority Data

Aug. 3, 1994 [JP] Japan ..... 6-202746

[51] Int. Cl.[6] ..... H01R 13/514

[52] U.S. Cl. ..... 439/752

[58] Field of Search ..... 439/752, 595, 439/596

[56] References Cited

U.S. PATENT DOCUMENTS 5,316,504 5/1994 Jinno .

FOREIGN PATENT DOCUMENTS 0596707 5/1994 European Pat. Off. .
0644620 3/1995 European Pat. Off. .
0183978 7/1990 Japan ..... 439/752

*Primary Examiner*—Neil Abrams
*Assistant Examiner*—Eugene G. Byrd
*Attorney, Agent, or Firm*—Jordan B. Bierman; Bierman, Muserlian and Lucas LLP

[57] ABSTRACT

A connector which includes a housing for receipt of terminal fittings, and a retainer which is capable of locking the terminals in place and preventing their withdrawal. The retainer is provided with a pair of side members which can resiliently flex so as to increase the spacing therebetween. On the surface of the housing, first and second locking projections are located extending outwardly in the direction of the side members. Each of the side members has an engaging portion which can receive the first and second projections. The retainer has a first locking position in which the first locking projection is engaged. In this position, the terminal fittings may be inserted into and/or withdrawn from the housing. After the terminals are properly placed, the retainer is moved into its second locking position wherein the second locking projection, as well as the first locking projection, is within the engaging portion. In this position, the terminal fittings are locked and cannot be removed. The height of the second locking projection is less than that of the first locking projection; this permits the side members to slide up over the second locking projection without allowing the first locking projection to be withdrawn from the engaging portion, thereby avoiding unwanted separation of the retainer from the housing.

12 Claims, 4 Drawing Sheets

CONNECTOR

This Application claims the benefit of the priority of Japanese Application 6-202746, filed Aug. 3, 1994.

The present Invention relates to a connector provided with a retainer, more specifically, to a connector having a retainer which is engageable with two types of projections to enable it to shift between a first locking position and a second locking position.

BACKGROUND OF THE INVENTION

In order to prevent terminal fittings from releasing, there has been developed a connector provided with a retainer as shown in FIG. 1. A plurality of cavities 3 extending in the lateral direction and open to the opposite front and rear walls is formed in housing 1 of the connector. A corresponding plurality of openings 10 in communication with cavities 3 is formed in the upper and lower surfaces thereof. Retainers 8 are disposed above and below housing 1 and are connected therewith via hinges 11. The retainers 8 are movable toward and away from housing 1. Retainers 8 are externally mountable on housing 1 and are provided with a pair of side members 12 at opposite sides, the members being deformable so as to widen the spacing therebetween. Each side member 12 is formed with window 13. On the other hand, recesses 15, engageable with corresponding side members 12, are formed at opposite side surfaces of housing 1. As shown in detail in FIG. 8, two types of projections (first locking projection 17 and second locking projection 18) are formed in each recess 15. When projections 17 engage windows 13, locking portions of retainers 8 enter openings 10, but do not enter cavities 3. In this first locking position, the insertion and withdrawal of terminal fittings 5 are permitted. Retainers 8 are moved toward housing 1 while widening the spacing between each pair of side members 12 so that both projections 17 and 18 are in windows 13. Then, locking portions 9 enter deeply into cavities 3 and engage terminal fittings 5, thereby preventing terminal fittings 5 from coming out (second locking position).

As described above, when retainers 8 shift from the first locking position, where only projections 17 are in windows 13, to the second locking position, where both projections 17 and 18 are in the windows 13, the pairs of side members 12 deform to widen the spacing between each pair. This shift of retainers 8 is shown in detail in FIGS. 9(*a*) to 9(*c*). While windows 13 of retainer 8 shift from the first locking position (as shown in FIG. 9(*a*)) to the second locking position, windows 13 are at least momentarily free of both projections 17 and projections 18 as shown in FIG. 9(*b*). Accordingly, unless the movement of retainers 8 is carefully controlled, they may be completely disengaged from housing 1, resulting in a cumbersome operation of having to mount retainers 8 on housing 1 again.

SUMMARY OF THE INVENTION

The Invention was developed in view of the above problem, and an object thereof is to provide a connector with a retainer which is not disengageable therefrom while it is moved from the first locking position to the second locking position.

In practicing the Invention to achieve the foregoing object, the height of the second locking projections is made less than the height of the first locking projections. Therefore, as the retainers move from the first locking position to the second locking position, the windows are still partially engaged by the first locking projections. Thus, the retainer can shift to its second locking position without danger of being released from the housing.

BRIEF DESCRIPTION OF THE DRAWINGS

In the accompanying drawings, constituting a part hereof and in which like reference characters indicate like parts.

Figure 1:
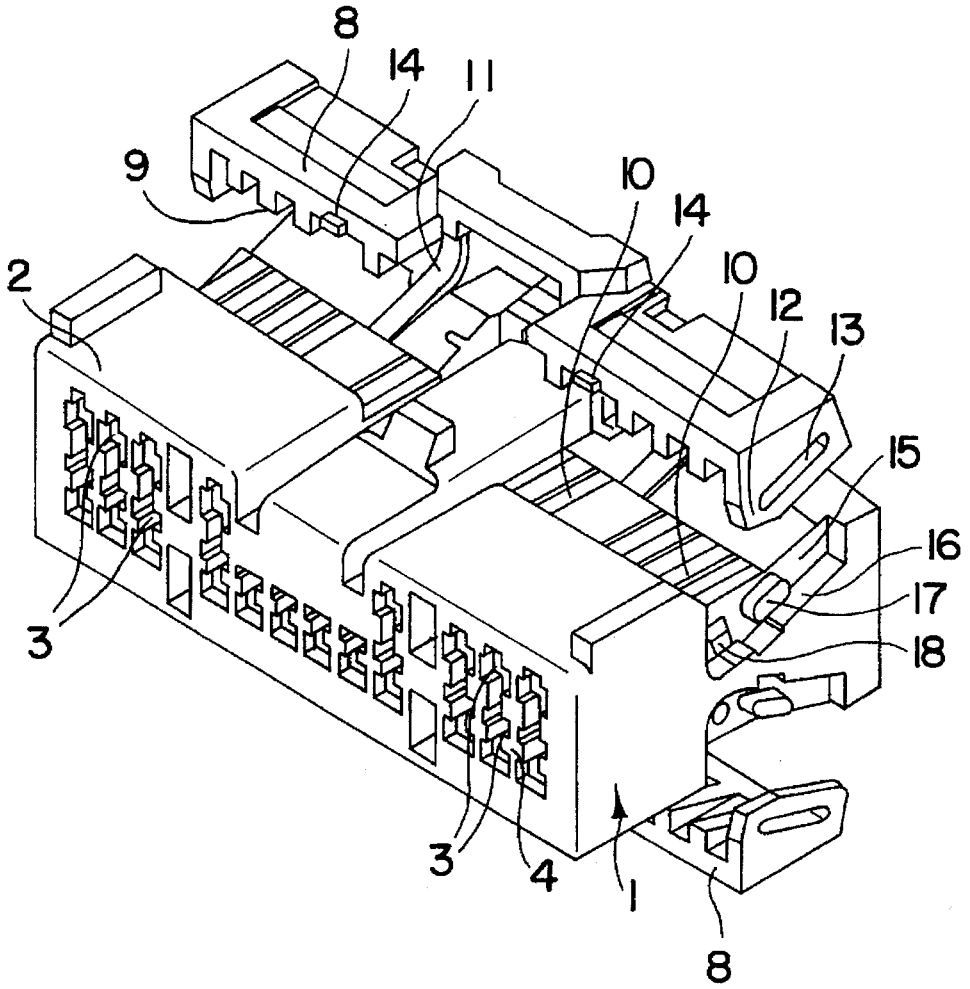
FIG. 1 PRIOR ART
FIG. 1 is a perspective view of a prior art connector.
Figure 2:
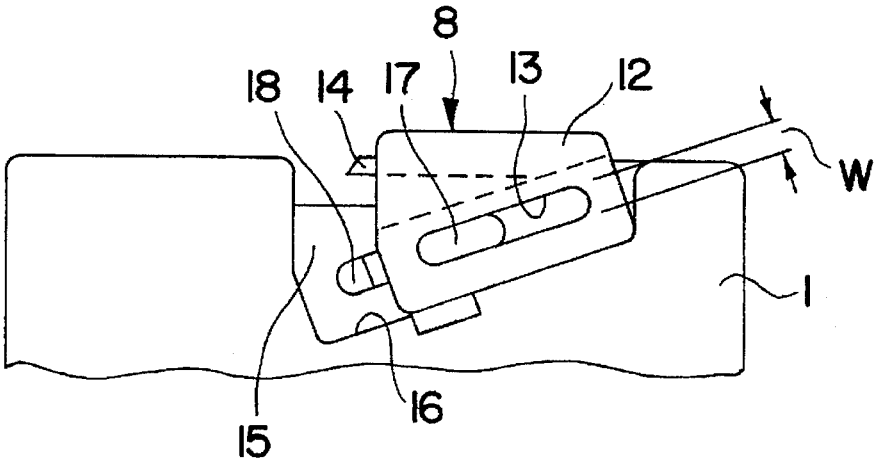
FIG. 2 is an enlarged partial side view of the connector with the retainer in its first locking position.
Figure 7A:
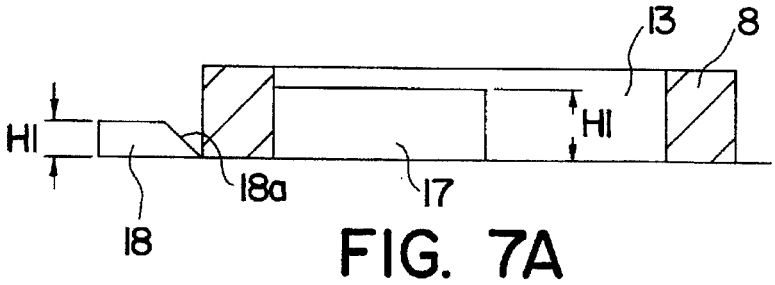
FIGS. 7(*a*) to 7(*c*) are sections showing the process of engagement of a side member by the projections.
Figure 7B:
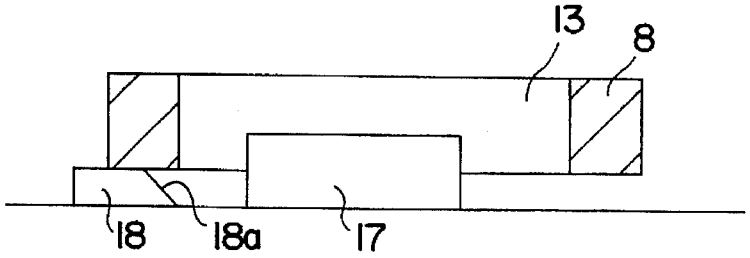
Figure 7C:
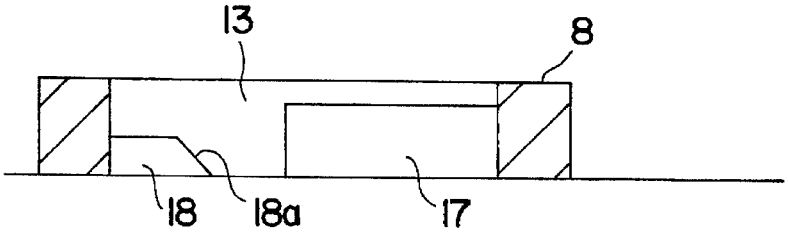
Figure 8:
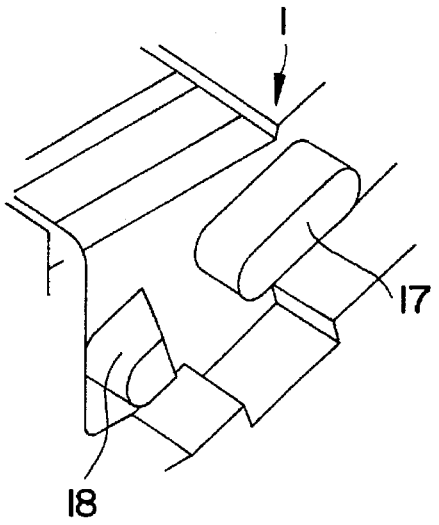
FIG. 8 PRIOR ART
FIG. 8 is a perspective view of the first and second engagement projections in a prior art connector.
Figure 9A:
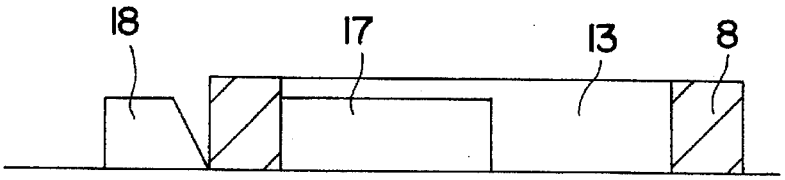
FIG. 9A PRIOR ART
FIGS. 9(*a*) to 9(*c*) are sections showing the process of engagement of a side member by the projections in the prior art connector.
Figure 9B:
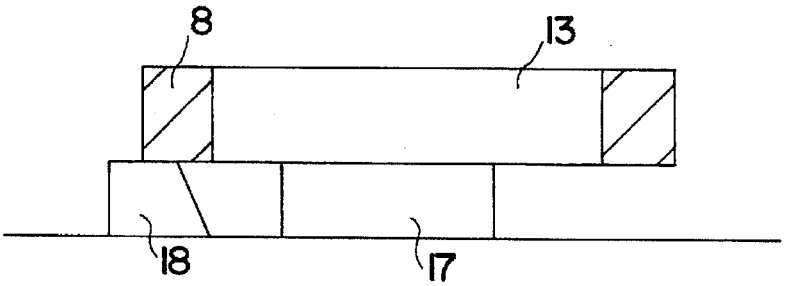
FIG. 9B PRIOR ART
Figure 9C:
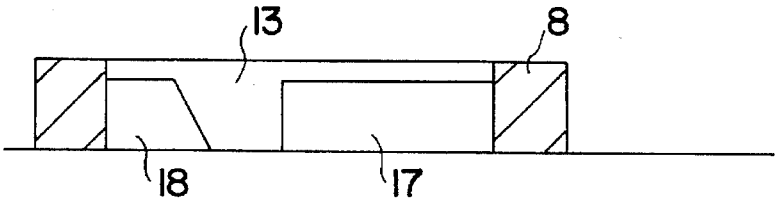
FIG. 9C PRIOR ART

Hereafter, the Invention is described in detail with respect to FIGS. 2 and 7; however, reference is made to FIG. 1 as regards the prior art features thereof.

Housing 1, unitarily formed of synthetic resin, is a female connector housing and carries fitting portion 2 which is complementary to an unillustrated male connector. Housing 1 contains a plurality of cavities 3 for accommodating terminal fittings 5. Cavities 3 extend in the forward/backward direction, are open to the opposed front and rear walls, and are separated by partition walls 4. Deflectable lance 6, engageable with inserted terminal fitting 5, is formed in each cavity 3. The leading end of each lance 6 is partially cut away to form engaging portion 7 to engage corresponding terminal fitting 5. Terminal fittings 5 are female terminal fittings and each is provided, at its leading end, with hollow connecting portion 5*a* into which the leading end of an unillustrated corresponding male terminal fitting is inserted. Engaging hole 5*b* at the lower surface of connecting portion 5*a* can be penetrated by lance 6. Jaw portion 5*c*, engageable by corresponding locking portion 9 of retainer 8, is formed at the upper surface of connecting portion 5*a*.

Figure 5:
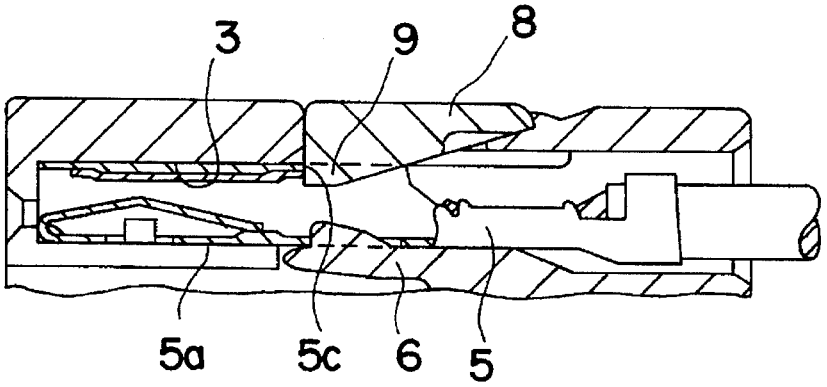
FIG. 5 is a side view in section of the connector with the retainer in its second locking position.
Figure 6:
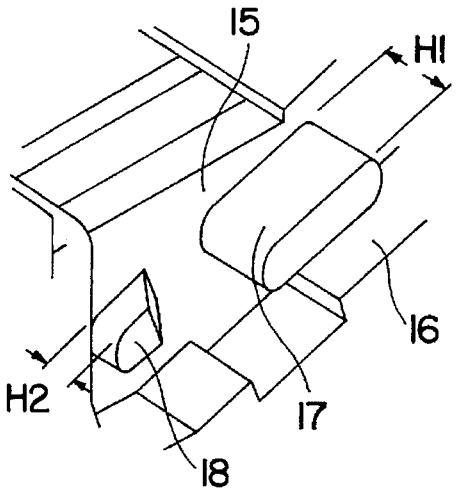
FIG. 6 is an enlarged perspective view showing the first and second engagement projections.

Retainers 8 are located above and below housing 1 and are coupled therewith via elastically deformable hinge members 11. Both retainers 8 are preferably unitarily formed with housing 1 in vertical symmetry. In each of the upper and lower surfaces of housing 1, a plurality of slits 10 extends in parallel relationship over a specified distance backward from fitting portion 2. Slits 10 correspond to cavities 3, and communicate therewith. Locking portions 9 are projectable into cavities 3 through openings 10, are arranged at the same pitch as cavities 3 along the longitudinal direction of retainers 8, and are in the form of projections tapered from their leading ends. They do not project into cavities 3 when retainers 8 are in their first locking positions, thereby permitting the insertion and withdrawal of terminal fittings 5. When retainers 8 are in their second locking positions, locking portions 9 project deeply into cavities 3 and engage jaw portions 5*c* of corresponding terminal fittings 5 as shown in FIG. 5. In this way, terminal fittings 5 are doubly locked by engagement by lances 6 and locking portions 9 of retainer 8; thus, they are securely retained in cavities 3.

A pair of side members 12 is formed at the opposite sides of each retainer 8, and the spacing between the pair of side members 12 is such that they can engage recesses 15 in the side walls of housing 1. Further, each pair of side members 12 is permitted to undergo elastic deformation so as to widen the spacing therebetween, and window 13 in the form of an oblong hole is provided in each of side members 12. Furthermore, a pair of projections 14 is formed on the surface of each retainer 8 facing fitting portion 2. Projections 14 engage recesses (not shown) formed in housing 1 when retainers 8 are in their second locking positions, thereby preventing undesired lifting of retainers 8.

On the opposite side surfaces of housing 1, recesses 15 are located in positions where side members 12 are fitted. The bottom surface (in a vertical direction) of each recess 15 is slanted, has a specified downward inclination, and acts as guide surface 16 for guiding the shifting of corresponding retainer 8 from the first locking position to the second locking position. In each recess 15, projections 17 and 18 project in a horizontal direction to hold retainer 8 in its first and second locking positions and are parallel to the inclination of guide surface 16. Recesses 15 are arranged symmetrically so as to correspond to vertically symmetrically disposed retainers 8.

Figure 3:
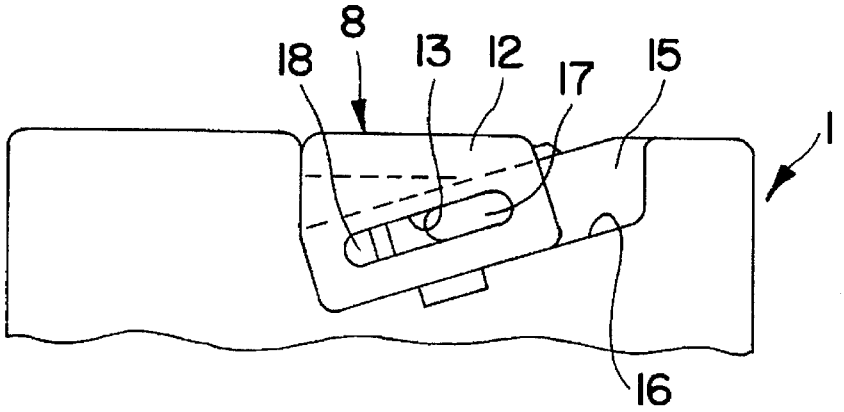
FIG. 3 is an enlarged partial side view of the connector with the retainer in its second locking position.
Figure 4:
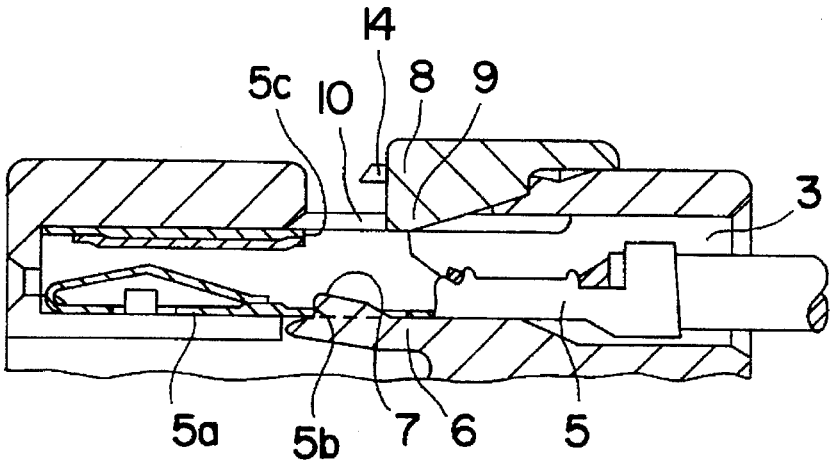
FIG. 4 is a side view in section of the connector with the retainer in its first locking position.

Projections 17 and 18 have the same width (dimension W in FIG. 2), which is substantially equal to the width of window 13. Further, the distance defined by the outer ends of projections 17 and 18 is substantially equal to the entire length of window 13. Accordingly, window 13 is engageable with projection 17 only, as shown in FIG. 2 (first locking position), and is also stably engageable with both projections 17 and 18, as shown in FIG. 3 (second locking position). In order to conform to the arcuate ends of window 13, both ends of projection 17 and the lower end of projection 18 in FIGS. 2 and 3 have a corresponding arcuate shape. Further, height H2 (in the projection direction) of projection 18 is slightly less than the thickness of side member 12, and is also less than the height of projection 17 (H1>H2). Thus, even while side member 12 moves over projection 18 so as to fit projection 18 in window 13 (FIG. 7(*b*)), projection 17 engages window 13 by a specified engagement margin. This engagement margin is such that the disengagement of retainer 8 from housing 1 is effectively prevented. Furthermore, the surface of projection 18 facing projection 17 is slanted surface 18*a* to assist retainer 8 in moving smoothly over projection 18.

When the connector is formed, retainers 8 are held in positions away from housing 1 as shown in FIG. 1 and are brought to their first locking positions prior to the insertion of terminal fittings 5. More specifically, hinges 11 are bent to bring retainers 8 closer to housing 1, and side members 12 enter recesses 15 to fit projections 17 in windows 13 (FIG. 7(*a*)). Since respective locking portions 9 do not enter cavities 3 at this stage, terminal fittings 5 can be smoothly inserted. Inserted terminal fittings 5 cause respective lances 6 to deflect out of cavities 3, but lances 6 return to their original shape thereafter because of their elasticity, with the result that engaging portions 7 of lances 6 engage holes 5*b*, thereby partially locking terminal fittings 5.

Subsequently, retainers 8 are moved into their second locking positions so that both projection 17 and projection 18 enter windows 13. As a result, retainers 8 are fixed in their second. locking positions. Since respective locking portions 9 of retainers 8 project into cavities 3 and engage jaw portions 5*c* of corresponding terminal fittings 5 in this position, terminal fittings 5 are retained so that they cannot come out of cavities 3.

While retainers 8 shift from their first locking positions to their second locking positions, side members 12 are displaced while being guided by guide surfaces 16 of recesses 15 and move over projections 18 while undergoing deformation to widen the spacing therebetween. Since windows 13 remain engaged by projections 17 due to the greater height thereof, the undesired disengagement of retainers 8 from housing 1 is avoided. When windows 13 have passed. over projections 18, side members 12 return to their original shape due to their elasticity. As a result, windows 13 are engaged by both projections 17 and 18 and retainers 8 are securely held in their second locking positions. Thus, retainers 8 cannot be inadvertently disengaged from housing 1 while shifting from their first locking positions to their second locking positions.

Various changes and modifications may be made in the invention without departing from the spirit thereof. For example, although projections 17 and 18 are fitted in one window 13, separate windows 13 may be formed therefor. In this case, window 13 for projection 17 is preferably an oblong hole having a sufficient length to permit the sliding movement of retainer 8. Alternatively, the Invention may be applied to male connectors, or the number of contacts, the number of hinges, etc. may be varied as desired.

These and other changes may be made while remaining within the scope of the Invention, which is not to be limited except by the character of the claims appended hereto.

What I claim is:

1. A connector comprising:

a housing, at least one retainer having a pair of side members which are deformable so as to widen a spacing therebetween, a first locking projection and a second locking projection on a surface of said housing and facing said one of said side members, and an engaging portion in said one of said side members having a length in an insertion and withdrawal direction of said retainer said engaging adapted to hold said retainer in a first locking position, in which said engaging portion engages said first locking projection and in which insertion and withdrawal of terminal fittings into and out of said housing are permitted.

said engaging portion adapted to hold said retainer in a second locking position, wherein said engaging portion engages both said first locking projection and said second locking projection and in which said terminal fittings are retained in said housing, said side members undergoing deformation when said retainer is shifted between said first locking position and said second locking position, said first locking projection and said second locking projection being located so that a distance in said direction between outer ends of said projection is substantially equal to said length of said engaging section, wherein said first locking projection has a first height and said second locking projection has a second height, said second height being less than said first height.

2. The connector of claim 1 wherein there is a pair of first projections, one on each opposite said surface of said housing and facing one of said side members, a pair of second projections, one on each opposite said surface of said housing and facing one of said side members, an engaging portion in each of said side members, said first projections engaging each said engaging portion in each of said side members when said connector is in said first locking position, and said second projections engaging each said engaging portion in each of said side members when said connector is in said second locking position, each of said first projections having said first height and each of said second projections having said second height.

3. The connector of claim 1 wherein said engaging portion is a recess in at least one of said side members.

4. The connector of claim 3 wherein said recess extends through one of said side members, thereby forming a window.

5. The connector of claim 1 wherein at least one said surface is provided with a ramp which guides said retainer from its first locking position to its second locking position.

6. The connector of claim 3 wherein said recess is elongated in a direction parallel to movement of said retainer from said first position to said second position and has a height perpendicular to said direction and parallel to said surface, at least one of said first projection and said second projection has a depth in said direction slightly less than said height, whereby at least one of said first projection and said second projection slide in said recess and guide said retainer from said first locking position to said second locking position.

7. The connector of claim 1 wherein there are two said retainers, a first said retainer on top of said housing and a second said retainer on a bottom of said housing.

8. The connector of claim 1 wherein said retainer is connected to said housing by a connection member.

9. The connector of claim 8 wherein said connection member is a hinge.

10. The connector of claim 1 wherein said second projection has an end face sloping upward in a direction of movement of said retainer from said first position to said second position.

11. The connector of claim 1 wherein said terminal fittings are introduced into a corresponding plurality of cavities, a locking portion adjacent ends of said cavities and adapted for deformation between a rest position, wherein said locking portion does not project into an adjacent cavity, and a closed position, wherein said locking portion enters said adjacent cavity and thereby secures said terminal fittings therein, said locking portion being caused to move from said rest position to said closed position by movement of said retainer from said first position to said second position.

12. The connector of claim 1 wherein a deflectable lance is provided on said housing biased into one of said cavities through an engaging hole, a sloping surface on said lance extending further into said cavity in an insertion direction of said terminals, whereby insertion of one of said terminals moves said lance out of said one of said cavities until said one of said terminals is fully inserted, an opening in said one of said terminals in register with an engaging portion of said lance, whereby resilience of said lance causes said engaging portion to enter said opening and lock said one of said terminals in place.

* * * * *